United States Patent [19]

Buchanan et al.

[11] 4,314,589

[45] Feb. 9, 1982

[54] DUPLEX FORMING FABRIC

[75] Inventors: John G. Buchanan, Ottawa; Donald G. MacBean, Barrhauen Cres., both of Canada

[73] Assignee: JWI Ltd., Montreal, Canada

[21] Appl. No.: 179,733

[22] Filed: Aug. 20, 1980

Related U.S. Application Data

[63] Continuation of Ser. No. 953,928, Oct. 23, 1978.

[51] Int. Cl.[3] ..... D03D 15/00

[52] U.S. Cl. ..... 139/383 A; 139/425 A; 162/348; 162/DIG. 1

[58] Field of Search ..... 139/383 R, 383 A, 408, 139/409, 410, 411, 412, 413, 414, 415, 420 R, 425 A, 426 R; 162/358, 348, DIG. 1, 205

[56] References Cited

U.S. PATENT DOCUMENTS

| | | | |
|---|---|---|---|
| 2,237,115 | 4/1941 | Santos | 139/383 A |
| 2,503,629 | 4/1950 | Miseall | 139/413 |
| 2,934,097 | 4/1960 | Hindle et al. | 139/383 A |
| 2,949,134 | 8/1960 | Hindle et al. | 139/383 A |
| 3,075,274 | 1/1963 | Mizell | 139/383 A |
| 3,214,326 | 10/1965 | Lee | 162/205 |
| 4,112,982 | 9/1978 | Bugge et al. | 162/348 |

FOREIGN PATENT DOCUMENTS

| | | | |
|---|---|---|---|
| 1992331 | 4/1959 | France | 139/383 A |
| 2022638 | 6/1978 | United Kingdom | 139/383 A |

*Primary Examiner*—Henry Jaudon
*Attorney, Agent, or Firm*—Alan Swabey; Robert Mitchell; Guy Houle

[57] ABSTRACT

A paper forming fabric having two layers of synthetic weft strands with interwoven synthetic warp strands and approximately 100% warp fill. The upper layer of the fabric comprises a regular array of mesh openings in which the distance between consecutive openings measured in the weft direction is never greater than the thickness of a single warp strand and measured in the warp direction is never greater than the thickness of a single weft strand.

4 Claims, 26 Drawing Figures

DUPLEX FORMING FABRIC

This is a continuation of application Ser. No. 953,928, filed Oct. 23, 1978.

BACKGROUND OF INVENTION (a) Field of the Invention

This invention relates to forming fabrics for paper making machines and is particularly directed to the provision of an improved duplex forming fabric comprising two layers of synthetic weft strands woven with synthetic warp strands.

(b) Description of Prior Art

Forming fabrics for paper making machines should provide uniform support for the fibres of the pulp stock so that marking of the formed web of paper by aberrations at the supporting surface will be minimized. The fabrics must be stable in the plane of the cloth, flexible at least in the machine direction, resist stretching, resist wear and at the same time provide sufficient drainage capacity.

For many years, forming fabrics were woven of metal strands and while these "wires", as they are called, provided most of the essential requirements, they had a short life span due to failure of the metal strands to resist flexural fatigue, wear and corrosion. Further, due to the nature of metal strands the woven wires could be easily damaged and damaged areas were generally not repairble.

In recent years, forming wires have been woven of plastic polymeric strands and while these have largely overcome the disadvantages of metal strands insofar as resistance of fatigue, wear, corrosion and inadvertent damage is concerned, some of the more desirable qualities of the metal strands were lost. For example, difficulties have been experienced with plastic fabrics that have been woven in the same manner as metal wires, that is, with about 50% warp fill, with respect to dimensional stability, resistance to stretching and also with respect to drainage and fibre support. Although many improvements have been made to produce reasonably satisfactory synthetic forming fabric, still some of the desirable properties of metal fabrics have not been regained.

Recently, synthetic forming fabrics have been woven in duplex weaves having two or more layers of interwoven weft strands and these have provided greater dimensional stability and resistance to stretching while maintaining the good wearing and damage resistant qualities of single layer synthetic fabric. Duplex fabrics are woven with 100% warp fill or greater and due to the nature of the weave, inevitably have an uneven surface that tends to leave a characteristic and objectionable mark on the surface of the paper. Moreover, no amount of stretching during heat setting will alleviate this objectionable sheet marking condition, but, in fact, will generally make it worse.

"Warp fill" is defined as the amount of warp in a given space relative to the total space considered. For example, 50% warp fill means that 50% of the space in the weft direction is taken up by warp. For example, a 68 mesh fabric (i.e. 68 warp strands per inch of width) having 0.008 inch diameter warp strands would have a warp fill factor of $68 \times 0.008 \times 100 = 54.4\%$. Wrap fill can be over 100% when there are more warp strands jammed into the available space than the space can dimensionally accommodate in a single plane. Fabrics having a nominal warp fill of approximately 100% will generally have an actual calculated warp fill of from 90% to 125%. Values over 100% are brought about by crowding and lateral undulation of the warp strands.

Attempts have been made to produce in the double layer fabric a monoplane surface by interweaving the upper layer of weft strands in such a way that when tension is applied during heat setting the top layer weft strands will behave like those of a single layer fabric and, due to crimp exchange, a more monoplane surface will be produced. Such a fabric is taught in U.S. Pat. Nos. 4,071,050 and 4,041,989 issued to Codorniu and Johansson et al; respectively.

The disadvantage of the fabric of these patents is that like most other double layer forming fabrics of the prior art, all of which have about 100% warp fill, the warp strands are woven so that each one rises to the upper surface to bind the upper layer of weft. Adjacent warp strands contact each other where they cross between the weft strands at the upper layer and this results in restricted drainage due to a lack of mesh opening facing the pulp stock at the places where these adjacent warp strands cross each other.

SUMMARY OF INVENTION

The duplex fabric of the present invention provides an upper pulp web supporting surface that resembles that of single layer open mesh woven wire cloth. That is, the upper layer of the duplex fabric comprises a regular array of spaced mesh openings each opening encompassed by a pair of upper weft strands and by a pair of spaced warp strands. The distance between consecutive mesh openings, measured in a straight line in the weft direction is never greater than the thickness of a single intervening warp strand measured in the same straight line. Similarly, the distance between consecutive mesh openings measured in a straight line in the warp direction is never greater than the thickness of a single waft strand measured in the same straight line. After being heat set under conditions of controlled tension the upper knuckles of the warp and weft strands will lie substantially co-planar with the upper surface of the fabric. The array of mesh openings, each being spaced by not more than one intervening warp or weft strand will allow virtually unimpaired drainage while, at the same time, the co-planar knuckles provide good support for the fibres of the pulp, a combination that is not obtainable with duplex forming fabric of the prior art.

A distinctive characteristic of the fabric of the present invention is that the weft strands in the lower layer are duplexed under, at the most, every second weft strand of the upper layer. Thus, there are a fewer number of weft strands in the lower layer and this allows better drainage consistent with the improved drainage of the upper layer.

Another characteristic of the fabric of the invention is that some of the warp strands weave only with the lower weft strands and do not interweave with any of the upper weft strands. These lower level warp strands besides serving as a means of spacing some of the upper warp strands also provide good dimensional stability. Further, since the lower weft strands are spaced further apart, the warp strands that interweave them have a shallower crimp and lie more nearly in the plane of the fabric and therefore stabilize the fabric against stretching in the machine direction. Also, the shallow crimp of these lower warp strands provides increased knuckle length which promotes better wear potential.

According to the above characteristics of the present invention, from a broad aspect, there is provided a paper forming fabric having two layers of synthetic weft strands with interwoven synthetic warp strands and approximately 100% warp fill. The upper layer of the fabric comprises a regular array of mesh openings which are spaced apart in the weft direction by a distance not greater than the thickness of a single intervening warp strand and in the warp direction by a distance not greater than the thickness of a single intervening weft strand. The upper surface of the fabric has a plurality of knuckles, formed by the interwoven weft and warp strands, which are essentially tangent to the plane of the fabric on which the paper is to be formed.

BRIEF DESCRIPTION OF DRAWINGS

The preferred embodiment of the present invention will now be described with reference to the examples thereof illustrated by the accompanying drawings in which:

The drawings, FIGS. 3 to 5 show the weave patterns in a simplified manner in order that they may be more easily visualized. In actual practice, the upper and lower layers of weft will lie closer together as the warp strands weaving the one layer interdigitate with the adjacent warp strands weaving the other layer.

In the top surface views, FIGS. 2B, 3B, 4B and 5B the strand knuckles have been indicated by ovals to represent where they might lie substantially tangent to the top plane of the fabric, thus illustrating a slightly worn condition for the sake of clarity. Representative mesh openings are indicated at R, X and Y, signifying openings equivalent to approximately one, three and five warp diameters respectively, in the weft direction. S in FIG. 3B signifies an unusual twinned opening peculiar to the 4 shaft 8 repeat pattern.

Figure 1:
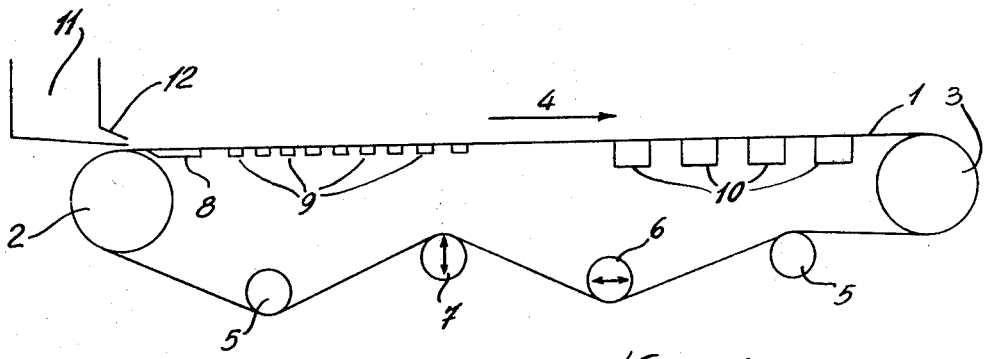
Fig. 1 (PRIOR ART)
FIG. 1 is a schematic view of a typical forming section of a paper making machine.
Figure 2A:
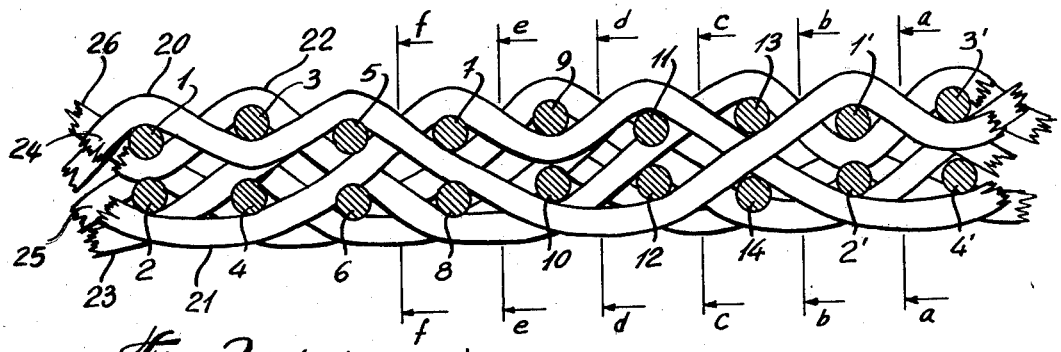
Fig. 2A (PRIOR ART)
FIG. 2A is an enlarged sectional side view of a portion of a 7 shaft 8 repeat pattern duplex forming fabric of the prior art.
Figure 2B:
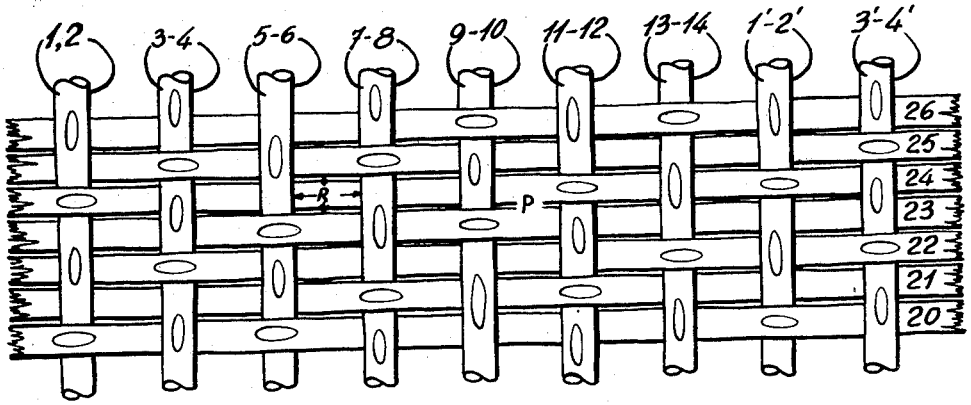
Fig. 2B (PRIOR ART)
FIG. 2B is a view of the upper surface of the fabric of 2A.
Figure 2C:
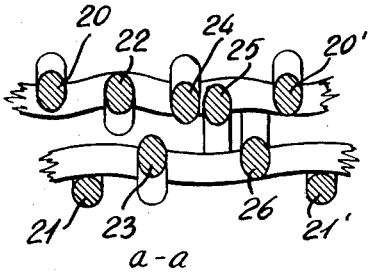
Fig. 2C (PRIOR ART)
FIGS. 2C to 2H are cross-section views along section lines a—a to f—f of FIG. 2A.
Figure 2D:
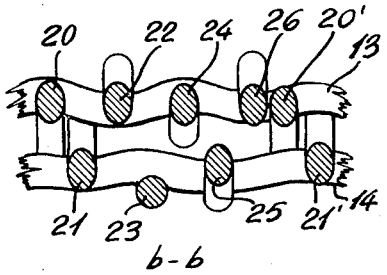
Fig. 2D (PRIOR ART)
Figure 2E:
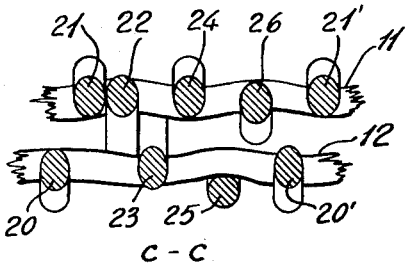
Fig. 2E (PRIOR ART)
Figure 2F:
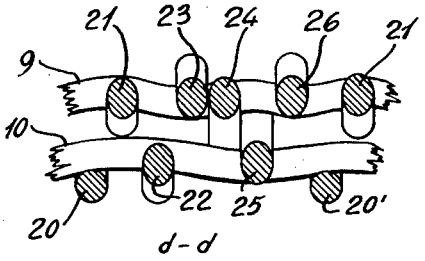
Fig. 2F (PRIOR ART)
Figure 2G:
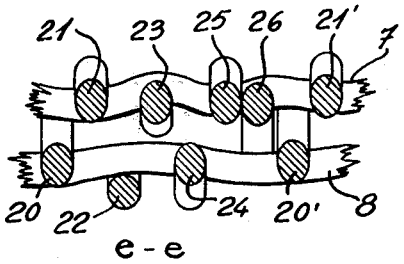
Fig. 2G (PRIOR ART)
Figure 2H:
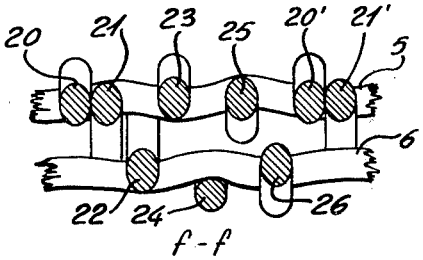
Fig. 2H (PRIOR ART)

Referring to FIG. 1 which illustrates a conventional forming section of a Fourdrinier paper making machine, the upper run of fabric 1, moves in a direction from the breast roll 2 to the couch roll 3, as indicated by arrow 4. The fabric passes from the breast roll 2 over a forming board 8, over foils 9, and then over suction boxes 10 before passing around the couch roll 3. The lower or return run of the fabric 1 is supported by return rolls 5 and passes over a guide roll 6 and a tensioning roll 7. Pulp stock is supplied to the upper surface of fabric 1 by means of a headbox 11 through a slice orifice 12. As the pulp stock progresses along with the upper run of the fabric 1, water is withdrawn at the foils 9 as the web of fibres is formed and further dewatering occurs at the suction boxes 10 and the couch roll 3 before the web (not shown) is released from the upper surface of the fabric at the lower reach of the couch roll 3 or just beyond.

The fabric 1 is driven by the couch roll 3 at speeds up to 900 meters per minute or more and at tensile loads they may surpass 14 kg per linear cm, of fabric width. It will be appreciated therefore that the fabric 1 must be strong and flexible yet have good dimensional stability and at the same time provide adequate and uniform support for the fibres of the pulp stock that are forming the sheet of paper. The fabric 1 must also have good drainage capacity to permit removal of water from the pulp stock at a high rate.

FIGS. 2A to 2H there is shown a duplex fabric of the prior art such as in U.S. Pat. No. 4,071,050, and which comprises two layers of weft strands numbered 1 to 14, repeating as 1', 2', 3', 4' etcetera, with interwoven warp strands numbered 20 to 26 consecutively. The weft strands are paired, being positioned substantially one above the other. Each warp strand passes between a pair of weft strands, over the next pair, between a third pair over a fourth pair, between a fifth pair, under a sixth and seventh pair and then repeats the sequence. For example, in FIG. 2A warp strand 20 passes over the weft strands 1 and 2, between 3 and 4, over 5 and 6, between 7 and 8, under 9, 10, 11 and 12, between 13 and 14 and then repeats the sequence, passing over 1' and 2' and between 3' and 4' and so on. Consecutive warp strands 21 to 26 each follow the same weaving pattern but, in order to break up an undesirable oblique ridge-like pattern on the upper surface of the cloth caused by a stepped progression of warp and upper weft knuckles, the successive warp strands do not commence their weaving pattern over successive pairs of weft strands. As will be seen, for example, warp strand 21 does not commence its weaving pattern over weft strands 3 and 4 but over weft strands 7 and 8. Similarly warp strands 22, 23, 24, 25 and 26 follow the same weaving pattern but in different order. In any case, the pattern is repeated with the 8th consecutive warp strand which will weave in the same manner as the first warp strand 20.

It is characteristic of all synthetic duplex forming fabrics that adjacent warp strands lie against each other thus causing what is known as a 100% warp fill condition. In actual practice, due to crowing and lateral undulation of the warp strands as previously explained, the actual warp fill may vary from 90% to 120%. In the prior art fabric referred to, because each warp strand rises to the upper surface and each follows an identical path, the warp strands cross one another between upper layer weft strands thus forming blockages in the upper layer of the fabric. See, for example, in section d—d FIG. 2F, at warp strands 23 and 24. The representative blockage is shown at P in FIG. 2B. This blockage condition makes both drainage and fibre support at the upper surface of the fabric very uneven.

DESCRIPTION OF PREFERRED EMBODIMENT

Figure 3A:
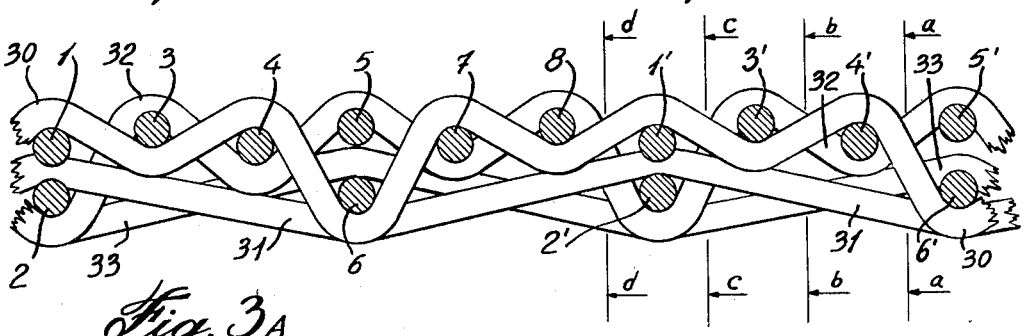
FIG. 3A is an enlarged sectional side view of a portion of 4 shaft 8 repeat pattern duplex fabric of the present invention.

FIGS. 3A to 3F show a 4 shaft 8 repeat pattern duplex fabric of the present invention. In FIG. 3A a set of weft strands 1 to 8, repeating as 1', 2', 3' etcetera is shown in cross-section and warp strands 30, 31, 32 and 33, repeating as 30', 31', 32' and 33' are shown as they are woven in each repeated pattern of four consecutive warp strands. Weft strands 1 and 5 in each set are duplexed by weft strands 2 and 6 respectively and there are no weft strands under 3, 4, 7 and 8 in each set. Warp strands 30 and 32 weave both the upper layer and the lower layer weft strands while warp strands 31 and 33 weave only the lower layer weft strands.

For example, warp strand 30 passes over weft strands 1 and 2, under 3, over 4 under 5 and 6, over 7 and under 8 and then repeats the sequence. The next warp strand 31 weaves only the bottom weft strands, passing between weft strands 1 and 2 under 3, 4, 5 and 6, 7 and 8 then repeats the sequence. Warp strand 32 weaves both upper and lower weft strands in the same pattern as warp strand 30 but weaving under weft strands 1 and 2 instead of 5 and 6. Warp strand 33 weaves only the lower weft strands in the same manner as warp strand 31 but over and under alternate lower weft strands.

Figure 3B:
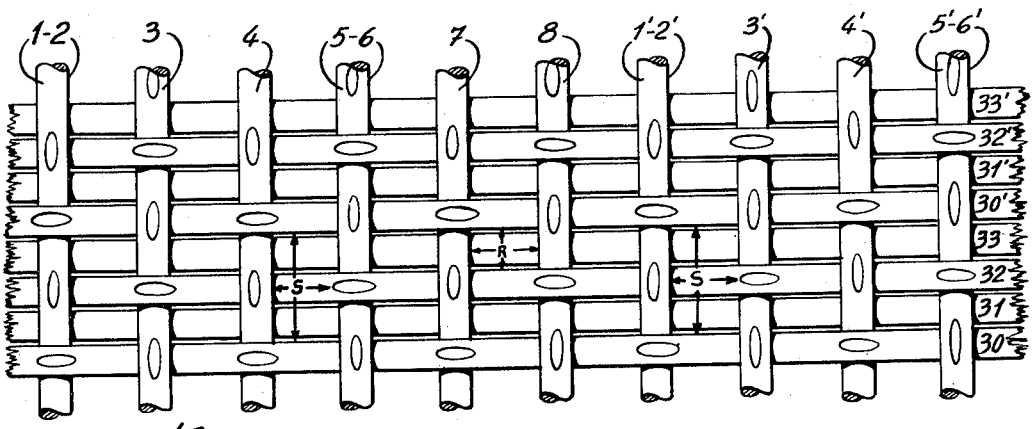
FIG. 3B is a view of the upper surface of the fabric of 3A.
Figure 3C:
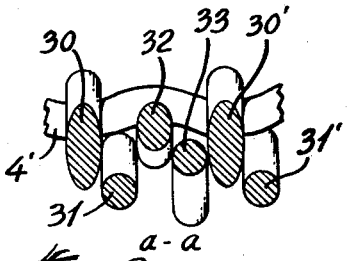
FIGS. 3C to 3F are cross-section views along section lines a—a to d—d of FIG. 3A.
Figure 3D:
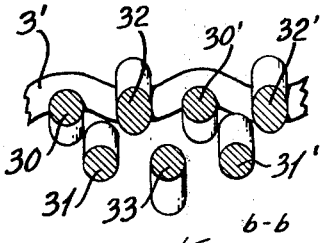
Figure 3E:
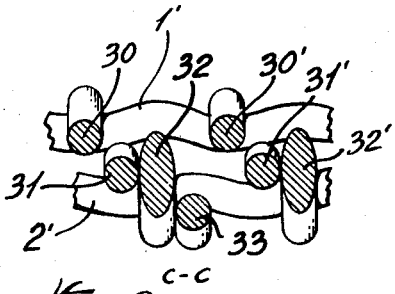
Figure 3F:
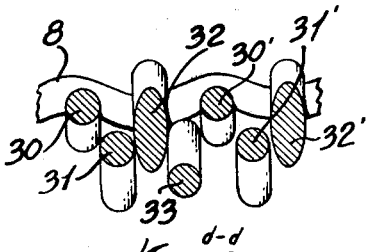

It will be apparent from FIG. 3B that warp strands 30 and 32, whose knuckles appear on the upper surface, will be held separated by warp strand 31, and, similarly, warp strands 32 and 30', whose knuckles also appear on the upper surface, will be held separated by warp strand 33. The weft strands form knuckles at the upper surface where they cross over warp strands which lie within the body of the fabric. The upper layer of the fabric thus contains regularly spaced mesh openings surrounded by spaced weft knuckles and spaced warp knuckles. Each of these openings is encompassed by a pair of upper weft strands and by a pair of the spaced warp strands and it will be seen that all adjacent upper level mesh openings are separated in the weft direction by a single warp strand and in the warp direction by a single weft strand. Some of the mesh openings, as shown at R, are substantially rectangular in shape while others, as shown at S, are twin openings.

The combination of the fewer number of weft strands in the lower layer and the fact that the lower layer warp strands 31 and 33 are held separated by warp strands 30 and 32 that weave both upper and lower layers of weft obviously improves drainage at the lower layer. Also, the long slope of the knuckles of warp strands 31 and 33 at the lower surface of the fabric provides ample wearing surface, while the shallow crimp of the lower warp strands provides improved dimensional stability in the machine direction.

After being heat set, under condition of controlled tension, the upper knuckles of the warp and weft strands will lie substantially co-planar with the upper surface of the fabric. This is not shown in the drawings, as previously explained, whereby the position of all strands is more clearly discernible.

It will be seen in the cross-section views, FIGS. 3C to 3F, that adjacent warp strands always cross each other below the upper layer of weft strands thus preventing blockages in the upper layer of the fabric and thereby preserving the regular array of mesh openings.

Figure 4A:
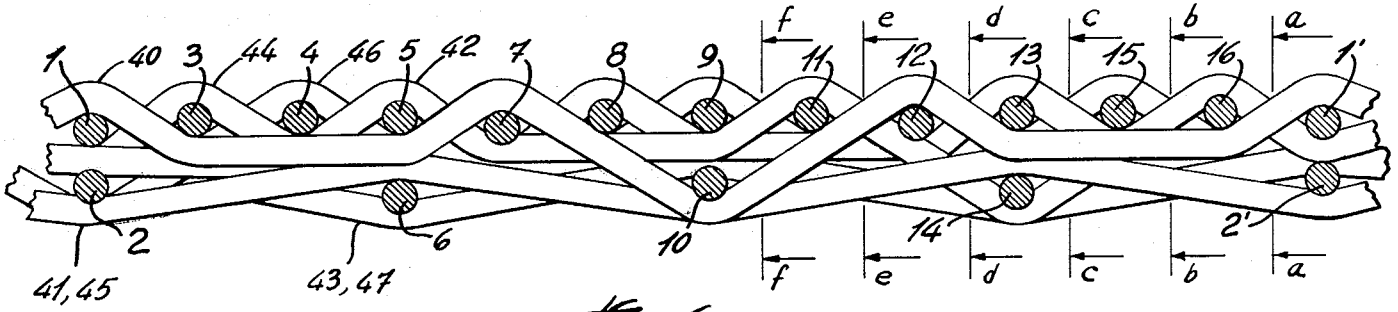
FIG. 4A is an enlarged section view of a portion of an 8 shaft 16 repeat pattern duplex fabric which is another embodiment of the present invention.
Figure 4B:
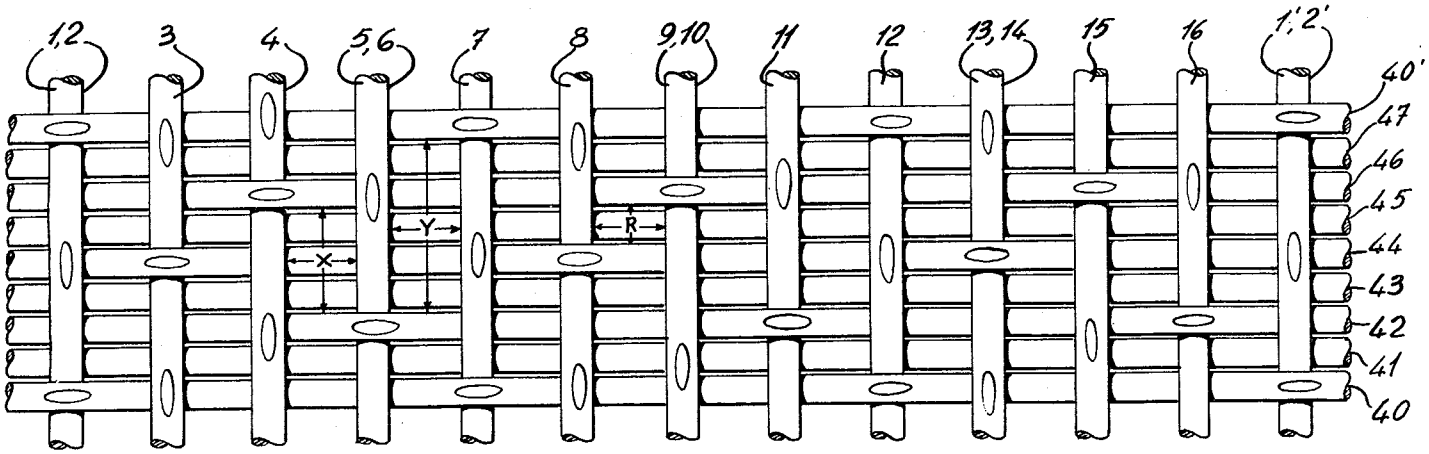
FIG. 4B is a view of the upper surface of the fabric of 4A.
Figure 4C:
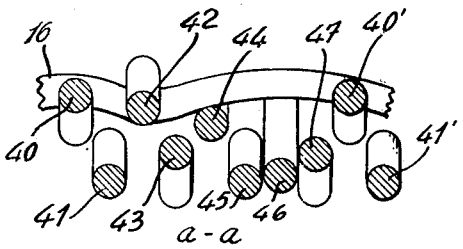
FIGS. 4C to 4H are cross-section views along section lines a—a to f—f of FIG. 4A.
Figure 4D:
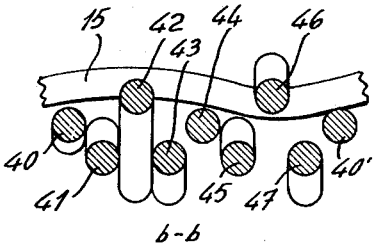
Figure 4E:
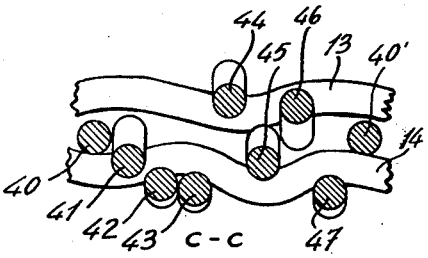
Figure 4F:
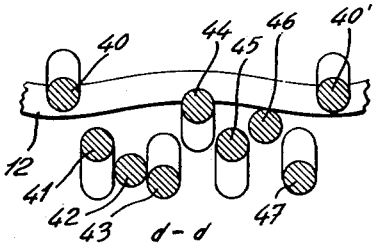
Figure 4G:
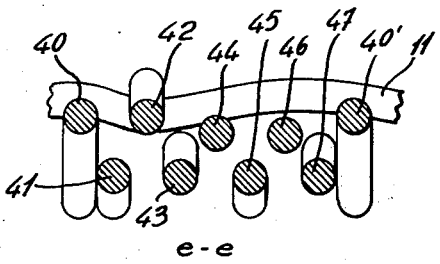
Figure 4H:
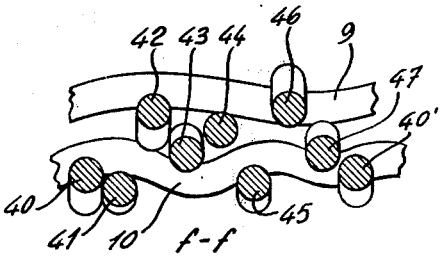

FIGS. 4A to 4H show an 8 shaft 16 repeat pattern duplex fabric, which is another embodiment of the present invention. A set of weft strands 1 to 16, repeating at 1', 2' ... etcetera, is shown in FIG. 4A in cross-section and warp strands 40, 41, 42, 43, 44, 45, 46 and 47 repeating at 40' etc., are shown as they are woven consecutively in each repeated pattern of 8. Weft strands 1, 5, 9 and 13 in each set are duplexed by 2, 6, 10 and 14 respectively and there are no weft strands located under upper weft strands 3, 4, 7, 8, 11, 12, 15 and 16. Warp strands 40, 42, 44 and 46 all weave both the upper and the lower layer weft strands in the same manner. That is, as seen in the case of warp strand 40, over weft strands 1 and 2, under weft strands 3 and 4, between weft strands 5 and 6, over 7, under 8, 9, 10 and 11 over 12 then between 13 and 14 and under 15 and 16 before repeating the sequence. Warp strands 41, 43, 45 and 47 weave only over and under the lower layer weft strands 2, 6, 10 and 14 as shown. As in the case of the 4 shaft 8 repeat pattern of FIGS. 3A to 3F, the warp strands 40, 42, 44 and 46 whose knuckles appear on the upper surface, as shown in FIG. 4B, are held separated by warp strands 41, 43, 45 and 47 respectively. Thus the upper layer of the fabric contains regularly spaced mesh openings that are separated in the weft direction by a single warp strand and in the warp direction by a single weft strand.

Again, the fewer number of weft strands in the lower level of the 8 shaft 16 repeat fabric, as well as the long slope of the lower knuckle, would have the advantages of better drainage, between wear resistance and better dimensional stability in the machine direction.

After being heat set, under condition of controlled tension the upper knuckles of the warp and weft strands will lie substantially co-planar with the upper surface of the fabric. This is not shown in the drawings, as previously explained, whereby the position of all strands is more clearly discernible.

As will be seen from the cross-section views, FIGS. 4C to 4H, adjacent warp strands always cross each other below the upper layer weft strands thereby preserving the regular array of mesh openings in the upper level of the fabric.

Due to the particular order in which the warp strands appear in the weaving pattern, a broken pattern in seen on the top surface. The same pattern of warp strands could, of course, be woven in sequence without the broken pattern effect if desired. The three sizes of upper surface mesh openings, designated as R, X and Y, which this weaving pattern produces are also apparent.

Figure 5A:
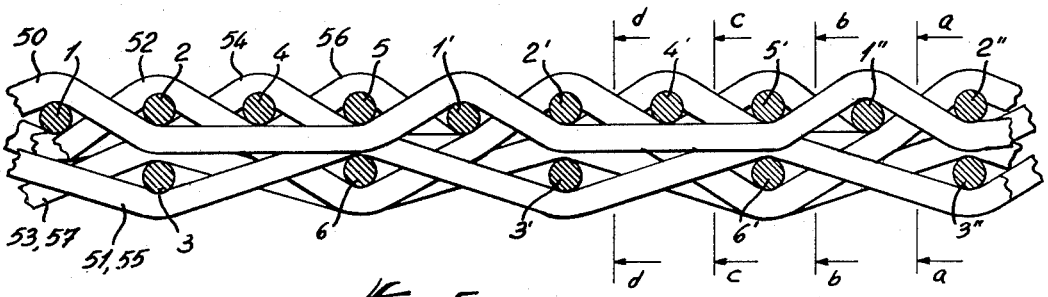
FIG. 5A is an enlarged sectional side view of a portion of 8 shaft 6 repeat pattern duplex fabric yet another embodiment of the present invention.
Figure 5B:
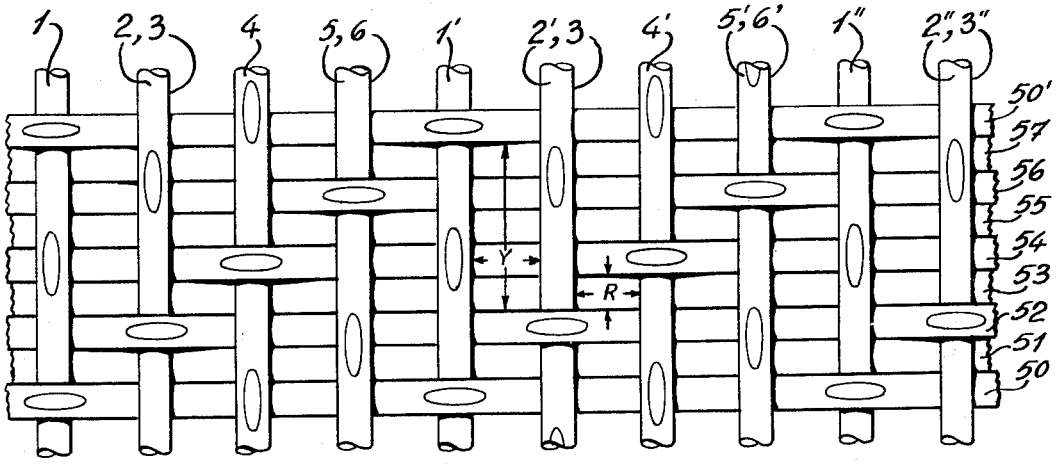
FIG. 5B is a view of the upper surface of the fabric of 5A.
Figure 5C:
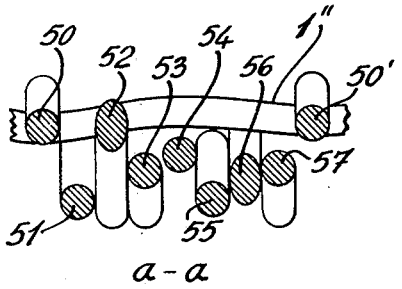
FIGS. 5C to 5F are cross-section views along section lines a—a to d—d of FIG. 5A.
Figure 5D:
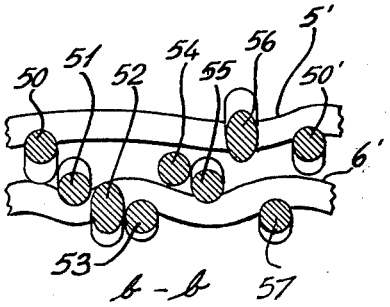
Figure 5E:
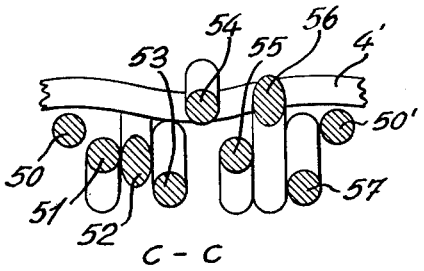
Figure 5F:
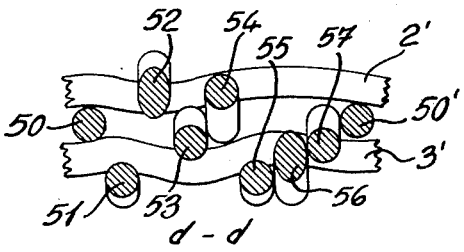

FIGS. 5A to 5F show an 8 shaft 6 repeat pattern duplex fabric which is yet another embodiment of the present invention. A set of weft strands 1 to 6, repeating at 1' to 6' and again as 1'', 2'' etcetera is shown in FIG. 5A in cross section. Warp strands 50 to 57 are shown as they are woven in each repeated pattern of eight consecutive warp strands. Weft strands 2 and 5 are duplexed by weft strands 3 and 6 respectively and there are no weft strands under weft strands 1 and 4 in each set. Warp strand 50 weaves only the top layer of weft strands passing over 1, between 2 and 3 under 4, between 5 and 6 and over 1' to repeat the sequence. Warp strand 51 weaves only the lower weft strands, passing under weft strands 1, 2, 3 and 4, between 5 and 6 then under 1', 2', 3' etcetera to repeat the sequence. Warp strand 52 weaves both upper and lower weft strands passing under 1, over 2 and 3, under 4, under 5 and 6 and under 1' to repeat the sequence. Warp strand 53 weaves only the lower weft strands alternately with warp strand 51. Warp strand 54 weaves only the upper weft strands following the pattern of warp strand 50 but commencing over weft strand 4. Warp strand 55 is next in sequence and weaves only the lower weft strands in the same manner as warp strand 51. Warp 56 weaves both upper and lower weft strands in the same pattern as warp strand 52 but passes first over weft strands 5 and 6. Warp strand 57 weaves only the lower weft strands in the same manner as warp strand 53. It will be seen in FIG. 5B that the warp strands whose knuckles appear on the upper surface of the fabric are held separated in the weft direction by the alternate warp strands that weave only the lower weft strands thus producing an array of regularly spaced mesh openings at the upper layer of the fabric as shown at R and Y. The openings, as in the other embodiments of the invention, are separated in the weft direction by a single warp strand. Again, the advantage of the fewer number of weft strands in the lower level is apparent.

After being heat set, under condition of controlled tension, the upper knuckles of the warp and weft strands will lie substantially co-planar with the upper surface of the fabric. This is not shown in the drawings, as previously explained, whereby the position of all strands is more clearly discernible.

As in the previously described weaving patterns of the invention it will be seen in the cross section views, FIGS. 5C to 5F, that adjacent warp strands always cross each other below the upper layer weft strands thereby preserving the regular array of mesh openings at the upper surface of the fabric.

The pattern of FIGS. 5A to 5F may be modified by having strands 50 and 54 each weaving alternate upper weft strands in the manner of plain weave instead of over one upper weft strand and under the next three upper weft strands as shown. This modification would provide a denser knuckle pattern on the upper without impairing drainage.

In summary, all weaving patterns of the present invention have the characteristic wherein the weft strands of the lower layer are duplexed under, at the most, every second weft strand of the upper layer.

It will be appreciated that it is within the scope of the invention that the lower weft strands might be different in diameter than the upper weft strands. Further, the lower weft strands might be of different synthetic material than the upper weft strands and both upper and lower weft strands might be of different material from the material of the warp.

It is also within the scope of the invention to use warp and/or weft strands that have other than a circular cross-section. In such cases, in the definition of the invention where reference is made to strand diameters in regard to spacing, this would be interpreted to mean horizontally projected dimension.

The configuration of the upper surface of the fabric of this invention can be plain weave, 3 shaft twill, 4 shaft twill, 4 shaft satin weave or any other known configuration.

We claim:

1. A paper forming fabric having two layers of synthetic weft strands with interwoven synthetic warp strands and approximately 100% warp fill, the upper surface of the fabric having a plurality of knuckles formed by said interwoven weft and warp strands being essentially tangent to the plane of the fabric on which the paper is to be formed, and wherein the upper layer of the said fabric comprises a regular array of mesh openings which are spaced apart in the weft direction by a distance not greater than the thickness of a single intervening warp strand and in the warp direction by a distance not greater than the thickness of a single intervening weft strand, said mesh openings being defined by the spacing between adjacent upper weft strands and by the spacing between warp strands which are held separated within the body of the fabric by at least one intervening warp strand, said at least one intervening warp strand being woven with lower layer weft strands and extending in its entire length below said top layer weft strands.

2. A paper forming fabric having two layers of synthetic weft strands with interwoven synthetic warp strands and approximately 100% warp fill, the upper surface of the fabric having a plurality of knuckles formed by said interwoven weft and warp strands being essentially tangent to the plane of the fabric on which the paper is to be formed, and wherein the upper layer of the said fabric comprises a regular array of mesh openings which are spaced apart in the weft direction by a distance not greater than the thickness of a single intervening warp strand and in the warp direction by a distance not greater than the thickness of a single intervening weft strand, said meshing openings being defined by the spacing between adjacent upper weft strands and by the spacing between warp strands which are held separated within the body of the fabric by at least one intervening warp strands, said at least one intervening warp strands being woven with lower layer weft strands and extending in its entire length below said top layer weft strands, said weft strands in a lower layer of the said fabric being deplexed, at the most, under every second weft strand in said upper layer whereby to allow better drainage throughout the thickness of the fabric.

3. A forming fabric as claimed in claim 1, wherein said weft strands in a lower layer of the said fabric are duplexed, at the most, under every second weft strand in said upper layer, said intervening warp strand having a shallower crimp than said top surface warp strands whereby to stabilize the fabric against stretching in the machine direction and to increase knuckle length in a lower surface of said fabric to increase wear resistance.

4. A forming fabric as claimed in claim 3, wherein some of said top surface warp strands are woven with top layer weft strands only.

* * * * *

UNITED STATES PATENT AND TRADEMARK OFFICE

CERTIFICATE OF CORRECTION

PATENT NO. : 4,314,589

DATED : February 9, 1982

INVENTOR(S) : John G. Buchanan et al

It is certified that error appears in the above-identified patent and that said Letters Patent are hereby corrected as shown below:

Column 1, line 64, "Wrap" should read -- Warp --.

Column 6, line 28, "between" should read -- better --.

Column 7, line 35, after "upper" insert -- surface --.

Signed and Sealed this

*Twenty-seventh* Day of *July 1982*

[SEAL]

*Attest:*

GERALD J. MOSSINGHOFF

*Attesting Officer*

*Commissioner of Patents and Trademarks*